US010233885B2

(12) United States Patent
Schuerz

(10) Patent No.: US 10,233,885 B2
(45) Date of Patent: Mar. 19, 2019

(54) PIEZO COMMON RAIL INJECTOR WITH HYDRAULIC CLEARANCE COMPENSATION INTEGRATED INTO THE SERVO VALVE

(71) Applicant: Continental Automotive GmbH, Hannover (DE)

(72) Inventor: Willibald Schuerz, Pielenhofen (DE)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 0 days.

(21) Appl. No.: 15/516,518

(22) PCT Filed: Oct. 13, 2015

(86) PCT No.: PCT/EP2015/073710
§ 371 (c)(1),
(2) Date: May 18, 2017

(87) PCT Pub. No.: WO2016/059069
PCT Pub. Date: Apr. 21, 2016

(65) Prior Publication Data

US 2017/0260950 A1 Sep. 14, 2017

(30) Foreign Application Priority Data

Oct. 15, 2014 (DE) ..... 10 2014 220 883

(51) Int. Cl.
*F02M 61/16* (2006.01)
*F02M 63/00* (2006.01)
*F02M 47/02* (2006.01)

(52) U.S. Cl.
CPC ..... *F02M 61/167* (2013.01); *F02M 47/027* (2013.01); *F02M 63/0026* (2013.01); *F02M 2200/703* (2013.01); *F02M 2200/705* (2013.01)

(58) Field of Classification Search
CPC ..... F02M 61/167; F02M 63/0026; F02M 2200/705; F02M 47/027; F02M 51/00;
(Continued)

(56) References Cited

U.S. PATENT DOCUMENTS 6,298,829 B1 10/2001 Welch et al. ..... 123/467
2015/0184627 A1 7/2015 Schuerz ..... 123/478

FOREIGN PATENT DOCUMENTS

DE 19708304 A1 9/1998 ..... F02M 47/02
DE 60036421 T2 6/2008 ..... F01L 9/04
(Continued)

OTHER PUBLICATIONS

German Office Action, Application No. 102014220883.1, 5 pages, dated Jun. 30, 2015.
(Continued)

*Primary Examiner* — Hung Q Nguyen
*Assistant Examiner* — Xiao Mo
(74) *Attorney, Agent, or Firm* — Slayden Grubert Beard PLLC

(57) ABSTRACT

The present disclosure relates to internal combustion engines. The teachings thereof may be embodied in injection valves with servo-valve control for injecting fuel into the combustion chamber. For example, an injection valve may include a valve pin connected to a valve body and an actuator preloaded by an actuator spring. The valve pin is fitted with a very small clearance to form a sealing gap between the valve pin and the valve body which includes bores. The lower end of the valve pin forms a coupling volume between the valve pin and the valve body, connected via the sealing gap and the bores to the valve chamber. The sealing gap provides a fluidic connection between the coupling volume and the valve chamber, but, during the short time of valve actuation, practically no exchange of fluid can
(Continued)

take place between coupling volume and valve chamber so that the coupling volume does not substantially change in said short time.

8 Claims, 2 Drawing Sheets

(58) Field of Classification Search
CPC ..... F02M 51/0603; F02M 63/0015; F02M 61/0026; F02M 2200/21
USPC ..... 239/88–92, 95, 533.2, 533.3, 533.8, 239/533.9, 96, 102.2
See application file for complete search history.

(56) References Cited

FOREIGN PATENT DOCUMENTS

| | | | | |
|---|---|---|---|---|
| DE | 102009000170 | A1 | 7/2010 | ..... F02M 47/02 |
| DE | 102012212614 | A1 | 1/2014 | ..... F02M 47/02 |
| EP | 1389274 | A1 | 2/2004 | ..... F02D 41/20 |
| EP | 1640604 | A1 | 3/2006 | ..... F02M 45/08 |
| EP | 2813698 | A1 | 12/2014 | ..... F02M 47/02 |
| WO | 2016/059069 | A1 | 4/1916 | ..... F02M 47/02 |

OTHER PUBLICATIONS

International Search Report and Written Opinion, Application No. PCT/EP2015/073710, 13 pages, dated Dec. 17, 2015.

PIEZO COMMON RAIL INJECTOR WITH HYDRAULIC CLEARANCE COMPENSATION INTEGRATED INTO THE SERVO VALVE

CROSS-REFERENCE TO RELATED APPLICATIONS

This application is a U.S. National Stage Application of International Application No. PCT/EP2015/073710 filed Oct. 13, 2015, which designates the United States of America, and claims priority to DE Application No. 10 2014 220 883.1 filed Oct. 15, 2014, the contents of which are hereby incorporated by reference in their entirety.

TECHNICAL FIELD

The present disclosure relates to internal combustion engines. The teachings thereof may be embodied in injection valves with servo-valve control for injecting fuel into the combustion chamber of an internal combustion engine.

BACKGROUND

Injection valves are typically used in conjunction with a highly pressurized so-called common-rail system. They may include a piezo element used as an actuator. The injection quantity of such common-rail injection valves may be controlled directly but predominantly indirectly by means of a servo valve. This means that the nozzle needle is not directly coupled to the movement of the piezo actuator, but rather the piezo actuator actuates a servo valve.

The fuel is typically supplied at very high pressure via a high-pressure port and a high-pressure line in the injection valve body through a valve plate to a throttle plate. A control chamber is connected via an inflow throttle to the high-pressure line. Furthermore, the control chamber is connected via an outflow throttle to a valve chamber. From the front or lower region pointing toward the combustion chamber, the nozzle needle is preloaded by means of a nozzle spring such that the latter exerts a closing force. Since the control chamber is connected via the high-pressure port to the rail system, in the non-actuated state that, in the control chamber, a high pressure prevails which corresponds to the pressure in the rail system (rail pressure). This results in an additional hydraulic action force which holds the nozzle needle in the closed position, and thus the openings of the injection valve are closed.

If the piezo actuator is actuated, it actuates the servo valve. Fuel then exits the control chamber via the outflow throttle. In this way, the pressure in the control chamber is lowered, and the nozzle needle is opened after a certain opening pressure threshold is reached. If the piezo actuator is subsequently discharged, the servo valve closes, the control chamber is charged again and the pressure in the control chamber builds up to the rail pressure level again, and the nozzle needle closes. Here, the dynamics of the pressure drop and/or pressure build-up in the control chamber, and the needle speed during the needle opening and needle closing movements, are substantially dependent on the dimensions of the inflow and outflow throttles.

To ensure stable operation of a common-rail injector with piezo actuator, a virtually clearance-free coupling between piezo actuator and the valve body of the servo valve is used. Precise steady-state temperature compensation of the thermal change in length is required in the entire drive chain to keep the change in the idle travel of the piezo actuator within narrow limits. For this purpose, the piezo actuator is normally surrounded by an Invar sleeve, which exhibits similar thermal expansion characteristics to the piezo actuator.

A small defined idle travel of the servo valve must be provided, e.g., a small intermediate space between the servo valve body and the base plate of the actuator, however, because it is necessary to prevent a situation in which the servo valve is open when the piezo actuator is in a non-activated state. Conversely, an idle travel set too large causes the required piezo actuator travel to be increased to the same extent, and this in turn correspondingly increases the activation energy required for this purpose. Altogether, this increases the demands on the precision of the system even over relatively long time periods. The use of injection valves in the engine involves thermally highly complex boundary conditions with different heat sources and heat sinks. In the region of the piezo actuator, the inherent heating from electrical losses may play a significant role. In the region of the servo valve, the temperature increase resulting from the expansion of the fuel from rail pressure to ambient pressure constitutes a significant heat source. As a result of the installation of the injector in the cylinder head of an engine, corresponding heat flows arise via various contact points, for example the combustion chamber seal and the contact between the nozzle tip and the combustion gases. An influential variable which must likewise be taken into consideration with regard to the idle travel is the clamping force in the cylinder head. This is also subject to large tolerances.

During steady-state injector operation, the resultant thermal expansions can be substantially compensated through suitable material selection and geometry. During dynamic engine operation, transient, inhomogeneous temperature distributions in the components yield an additional influential variable with regard to the idle travel of the piezo actuator. Furthermore, the idle travel varies during injector operation owing to changes in length of the piezo actuator resulting from polarization changes and wear.

Thermally induced changes in length can be substantially compensated through suitable use of different materials. One examples the use, already mentioned above, of actuator housings composed of Invar, because Invar exhibits substantially the same temperature expansion behavior as the piezo ceramic. Ultimately, however, this constitutes merely basic compensation. Changes in idle travel resulting from wear and/or changes in the polarization state are not addressed. To solve this problem, some piezo common-rail injection nozzles use a hydraulic coupler composed of a cylinder with a drive-input piston on the actuator side and a drive-output piston on the valve side. A disadvantage of this arrangement is that said hydraulic coupler is situated in the low-pressure region. To keep a coupler of said type functional, however, it is necessary to ensure a certain pressure level, normally approximately 10 bar. In the prior art, this is achieved by means of a pressure-maintaining valve.

The increasing use of fuel components with low boiling point, e.g., adding alcohol to the fuel, jeopardizes the functionality of corresponding hydraulic coupling elements in the low-pressure region, and thus constitutes a significant functional risk for such concepts.

EP 1 389 274 describes a directly actuated injection valve with a hydraulic coupler. This however has the disadvantage that the actuator is not adequately decoupled from the nozzle needle, which likewise makes the compensation of wear more difficult.

SUMMARY

The teachings of the present disclosure may be employed to avoid the abovementioned problems of known injection valves. They may be embodied in an injection valve with servo-valve control which firstly adequately decouples the actuator from the nozzle needle but secondly compensates the changes in length that occur owing to temperature fluctuations and wear of components during the operation of the injection valve.

For example, an injection valve with servo-valve control for injecting fuel into the combustion chamber of an internal combustion engine, may have an injector body (100) with an injection nozzle, the injection nozzle having a nozzle module (110) with a nozzle body (120) and with a nozzle needle (130). The the nozzle module (110) is arranged in the lower side, facing toward the combustion chamber, of the injector body (100), and the nozzle needle (130) corresponds with a nozzle spring (140) which is arranged so as to exert a closing force on the nozzle needle (130). The injection valve furthermore has a high-pressure line (210) which, at one location, has a connection to the high-pressure fuel system and which, at another location, is connected via an inflow throttle (230) to a control chamber (250), wherein the control chamber (250) is connected via an outflow throttle (270) to a valve chamber (300). A valve body (310) is arranged in the valve chamber (300), wherein the valve body (310) interacts with a valve spring (330) such that the valve spring (330) pushes the valve body (310) away from a throttle plate (290) such that a gap (340) remains between valve body (310) and throttle plate (290), wherein the valve body (310) is furthermore connected to a valve pin (350), which in turn is connected to an actuator (400) which is preloaded by an actuator spring (450). The valve pin (350) is fitted into the valve body (310) with a very small clearance such that a sealing gap (360) is formed between valve pin (350) and valve body (310), and the valve body (310) has bores (370) which connect the valve chamber (300) to the sealing gap (360). The lower end of the valve pin (350) is not entirely connected to the valve body (310), such that a coupling volume (380) is formed between valve pin (350) and valve body (310), which coupling volume is connected via the sealing gap (360) and the bores (370) to the valve chamber (300). The sealing gap (360) is dimensioned to be so small that, on the one hand, a fluidic connection exists between the coupling volume (380) and the valve chamber (300), but on the other hand, during the short time of valve actuation, practically no exchange of fluid can take place between coupling volume (380) and valve chamber (300), such that the coupling volume (380) practically does not change in said time.

In some embodiments, the actuator spring (450) is in the form of a corrugated spring (450) or corrugated tube spring (450).

In some embodiments, the actuator has piezo elements, e.g., in the form of a fully active piezo stack.

In some embodiments, the high-pressure fuel line (210) is connected via a nozzle aperture (240) to the interior of the nozzle body.

In some embodiments, the sealing gap (360) amounts to approximately 1 μm.

In some embodiments, the coupling volume (380) amounts to approximately 0.5 $mm^3$.

In some embodiments, the nozzle needle opens inwardly.

In some embodiments, the actuator (400) is preloaded and simultaneously sealed off by a corrugated spring (450).

BRIEF DESCRIPTION OF THE DRAWINGS

An example embodiment will be described below with reference to the figures, in which.

DETAILED DESCRIPTION

Figure 1:
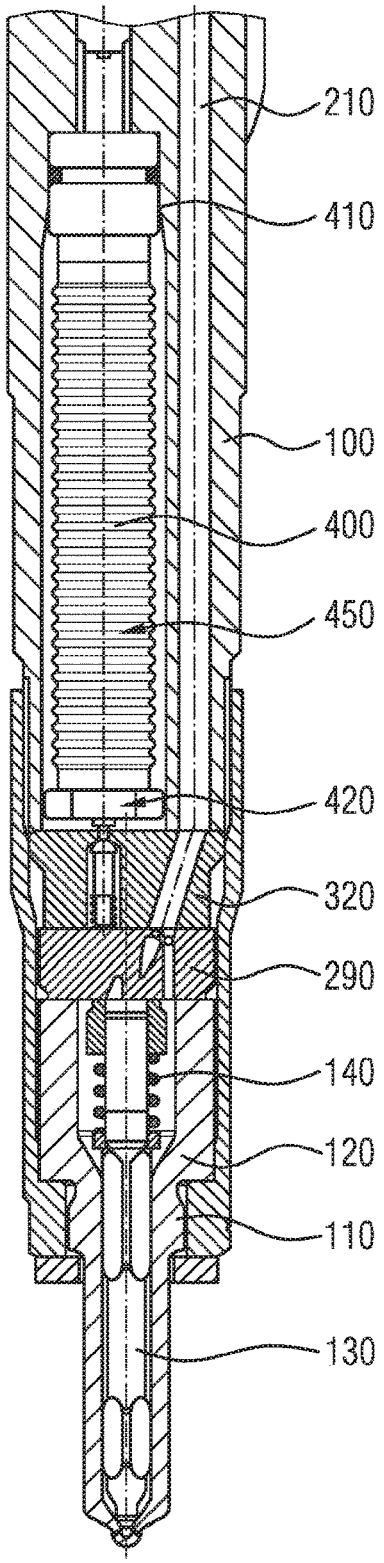
FIG. 1 shows a longitudinal section through the lower part of an injection valve according to teachings of the present disclosure.

Some embodiments include an injection valve with servo-valve control for injecting fuel into the combustion chamber of an internal combustion engine. The injection valve has an injector body with an injection nozzle, which in turn comprises a nozzle module with a nozzle body and with a nozzle needle. The nozzle module is arranged in the lower side, facing toward the combustion chamber, of the injector body. The nozzle needle corresponds with a nozzle spring such that the latter exerts a closing force on the nozzle needle. The injection valve is furthermore connected to a high-pressure line via which said injection valve is connected to the high-pressure fuel system (common rail). At another location, the high-pressure line is connected via an inflow throttle to a control chamber, wherein the control chamber is in turn connected via an outflow throttle to the valve chamber. A nozzle aperture can hydraulically assist the closing of the nozzle needle.

In the valve chamber itself, there is a valve body which interacts with a valve spring such that the valve spring pushes the valve body away from the throttle plate such that a gap remains between valve body and throttle plate in the rest state. The valve body itself is in turn connected to a valve pin, which in turn is connected to an actuator, e.g., a piezo actuator. In the case of a piezo actuator, this is normally preloaded by the actuator spring, in order that the layered structure of the piezoceramic layer stack of the piezo actuator is permanently mechanically stabilized.

The piezoceramic layer stack should not come into direct contact with the normally chemically aggressive fuel, e.g., diesel. Therefore, the valve typically includes a fluid seal isolating the piezo stack, for example in the form of a sealing diaphragm between piezo stack and fluid-conducting parts of the injector. Alternatively, the spring itself may impart a sealing action with respect to the fuel, for example as a corrugated spring or corrugated tube spring.

In some embodiments, the valve pin is fitted into the valve body with a very small clearance such that a sealing gap is formed between the valve pin and the valve body. The valve body itself has bores which connect the valve chamber to the sealing gap. Here, the lower end of the valve pin is not entirely connected to the valve body, such that a coupling volume is formed between valve pin and valve body, which coupling volume is connected via the sealing gap and the bores to the valve chamber. Since the valve chamber is connected via the outflow throttle to the control chamber, the valve chamber is, in the injection valve according to the invention, at high pressure (rail pressure).

This means that, via the bores in the valve body and the sealing gap between valve pin and valve body, the coupling volume is filled with fuel, wherein said fuel is likewise at rail pressure. Here, the sealing gap is dimensioned to be so small that, on the one hand, a fluidic connection exists between the coupling volume and the valve chamber, but on the other hand, during the short time of valve actuation, practically no exchange of fluid can take place between coupling volume and valve chamber, such that the coupling volume practically does not change in said time. Thus, the system composed of the bores in the valve body with the sealing gap and the coupling volume act as a hydraulic coupler.

When the valve is in a rest state, the coupler is at high pressure, such that a lowered boiling point of the fuel, for example as a result of admixing of components with low boiling point, such as bioalcohol, has no adverse effects. The time in which the valve is actuated, e.g., in which the actuator is deflected and the servo valve opens, wherein the pressure in the valve chamber falls, is so short that no significant quantity of liquid (fuel) can pass out of the coupling volume via the sealing gap and the bore in the valve body into the valve chamber in said time, such that the high pressure in the hydraulic coupler itself is maintained. Considered over a relatively long time, however, pressure equalization may occur via the fluidic connection that exists via the sealing gap between coupler volume and valve chamber, such that changes in length in the valve system over the long term can be compensated.

In some embodiments, the actuator has stacked piezo elements (piezo stack) and includes a fully active piezo stack, which generally exhibits a low tendency for crack formation in the interior of the piezo stack sequence. By contrast to a stack which is not fully active, not only parts of the respective piezoelectric layers of said stack are covered by electrode material, rather the stack is covered over its full area and the contacting in the piezo stack sequence is in alternating fashion at the edge from the stack side. Those layers which are respectively to be contacted with different polarity are in each case alternately insulated at the edge at said contact side.

The high-pressure fuel line may be connected via a nozzle aperture to the interior of the nozzle body, which serves for improved hydraulic control of the injection valve.

In some embodiments, the sealing gap between valve pin and valve body amounts to approximately 1 μm. The coupling volume may be approximately 0.5 $mm^3$. The nozzle needle of the injection valve may open inwardly, e.g., in diesel applications, because the pressures of the fuel may be very high and thus a high sealing force acts at the sealing seat of the injection valve. In the event of another reversal, which is familiar to a person skilled in the art, of the force of flow, it is possible for an outwardly opening valve to be used, e.g., with gasoline injectors. The actuator itself may be preloaded in order to stabilize the piezo actuator, and simultaneously sealed off, in order to protect the piezo stack, by a corrugated spring surrounding the actuator.

FIG. 1 shows portions of an injection valve according to the teachings of the present disclosure, situated substantially within an injector body 100. In the right-hand region there is a high-pressure fuel line 210 which, in the upper region of the injection valve, is connected by means of a high-pressure connection to a high-pressure fuel system, or common rail. On the left, adjacent to the high-pressure fuel line 210 is the actuator 400, which is surrounded by a corrugated spring 450 and connected by means of its actuator head plate 410 to the injector body 100.

The actuator 400 may comprise a piezo stack. It is however also possible for other materials, such as a magnetostrictive material, to be used. By means of a base plate of the actuator 420, said actuator is connected to, and acts directly on, a valve body 310 arranged in a valve plate 320. The high-pressure fuel line is also led through the valve plate 320 and, there, opens into the throttle plate 290 in the region of the inflow throttle 230 and of the nozzle aperture 240. In the lower part facing toward the combustion chamber, there is the nozzle module 110 itself, composed of the nozzle body 120, the nozzle needle 130 and the nozzle spring 140.

Figure 2:
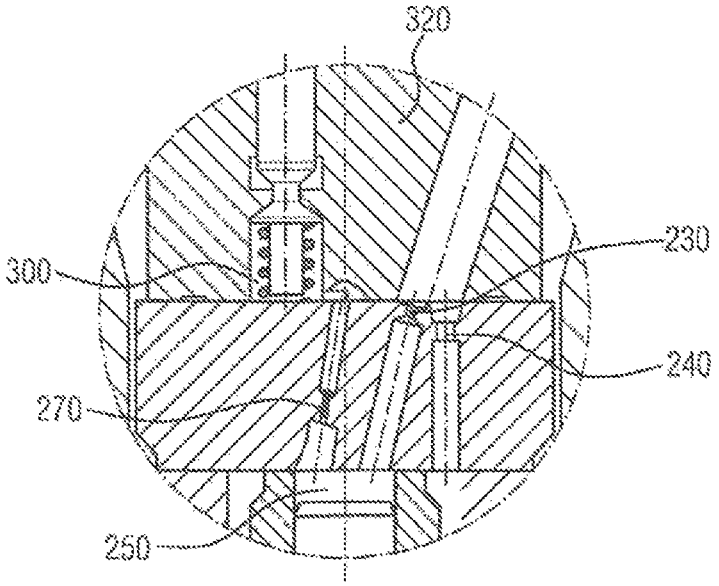
FIG. 2 shows a detail.
Figure 3:
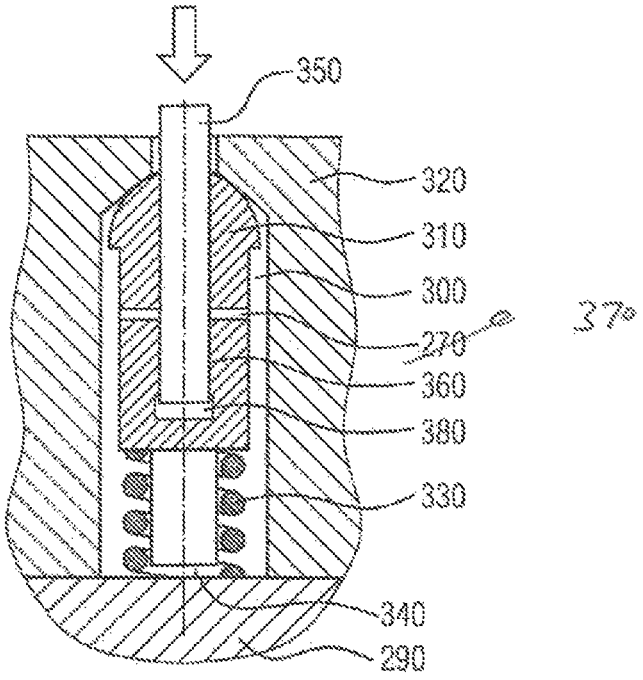
FIG. 3 shows a detailed drawing of the valve chamber in longitudinal section.

FIG. 2 shows the region around the throttle plate in somewhat more detail. From the top right, the fuel enters the system via the high-pressure fuel line 210 and is conducted via the inflow throttle 230 into a control chamber 250. In parallel with this, fuel is conducted via the nozzle aperture 240 past the control chamber 250 into the internal region of the nozzle module 110. The control chamber 250 is in turn connected to an outflow throttle 270, which leads to the valve plate 320. Said outflow throttle is adjoined there by the valve chamber 300, which is shown in more detail in FIG. 3.

The lower region of FIG. 3 shows again the throttle plate 290, which is adjoined by the valve chamber 300 which is formed in the valve plate 320. In the valve chamber 300 there is situated a valve body 320 which is surrounded, in its lower region, by a valve spring 330 which exerts an upwardly acting force on the valve body 310, such that a gap 340 is formed between valve body 310 and throttle plate 290 and the upper region of the valve body 310 is sealed off with the valve plate 320 and thus closes off the valve chamber 300 in an upward direction.

The valve body 310 includes bores 370 which open into a central bore. The valve pin 350 is guided with a very small clearance in said central bore, which valve pin is connected to the actuator (not shown here). Between the valve pin 350 and the wall of the valve body 210 there is situated a narrow sealing gap 360 via which the bore 370 is fluidically connected to a small intermediate space, the coupling volume 380. Thus, the idle-travel-afflicted mechanical coupling between piezo actuator stroke and servo valve movement is replaced by hydraulic coupling with clearance compensation integrated into the servo valve body itself. By contrast to the situation known from the prior art, high pressure, e.g., the rail pressure, prevails in the clearance compensation means integrated in the servo valve body, such that the boiling problems mentioned in the introduction cannot arise.

The mode of functioning is, in detail, as follows:

The piezo actuator 400, e.g., a fully active piezo stack, is integrated into the injector body 100 and supported, in an upward direction, directly in the injector body 100. The piezo actuator 400 may be sealed off with respect to the fuel-conducting regions in the injection valve by means of a corrugated spring 450. The corrugated spring 450 simultaneously ensures the preload of the actuator 400. Not the entire actuator chamber but only the region of the actuator 400 itself is sealed off with respect to the fuel. This is possible by dispensing with the Invar sleeve for temperature equalization. As a result, the low-pressure volume in the region of the actuator 400 is enlarged by at least an order of magnitude, which reduced the pressure pulses generated during the opening of the servo valve to a similar extent.

The stroke of the piezo actuator 400 is transmitted via the valve pin 350, which may be composed of hard metal, to the servo valve body 310. Here, the valve pin 350 moves with a very small clearance in the bore in the servo valve body 310. In the exemplary embodiment, at approximately the level of half of the height of the servo valve body 310, there are situated two radial bores 370, which connect the valve chamber 300 to the sealing gap 360 between valve pin 350 and servo valve body 310.

In the closed state of the servo valve, rail pressure prevails in the valve chamber 300 and is transmitted into the sealing gap 360 through the radial bores 370. Said pressure is then also transmitted into the very small coupler volume 380, which is situated at that face side of the valve pin 350 which is averted from the piezo actuator 400. Said pressure has the effect that the pin is at all times pushed outward until it comes into contact with the actuator base plate. Thus, clearance-free contact between piezo actuator 400 and servo valve is ensured. Movements with very low dynamics, such as for example temperature expansion and wear, can be compensated by a change in the coupler chamber height. For highly dynamic movements, however, such as the piezo movement, the sealing gap is virtually leak-tight, and thus the coupler is highly rigid.

If the piezo actuator 400 is actuated, the valve body 310 is pushed downward, such that the valve opens upward. In this way, fuel can escape upward, such that the pressure in the valve chamber 300 falls significantly. Thus, the servo valve is only held open counter to the valve spring force and a low hydraulic force.

As a result of the pressure drop in the valve chamber 300, fuel flows out of the control chamber 250 into the valve chamber 300 via the outflow throttle 270. Since less fuel flows in through the inflow throttle 213 than flows out through the outflow throttle 270, the pressure in the control chamber 250 falls. As a result, the hydraulic closing force acting on the nozzle needle 130 is reduced. After a particular pressure threshold is undershot, the nozzle needle 130 opens, and the injection begins.

If the piezo actuator 400 is expanded, the servo valve closes again by virtue of the valve body 310 being pushed and sealed off against the valve plate 320. The pressure in the valve chamber 300 increases again as does that in the control chamber 250, such that, as a result, the nozzle needle 130 is pushed downward into its seat again. The injection valve is closed.

The described example presents an inwardly opening injection valve. It is self-evident that, with corresponding force reversal, the use of an outwardly opening valve is also encompassed by the invention.

In order that the coupling by means of the coupler volume 380 functions correctly, the sealing gap 360 must be so small that, even in the presence of a high rail pressure, only a small leakage of fuel is possible, and at the same time no jamming of the valve pin 350 in the servo valve body 310 occurs. Typically, the sealing gap 360 is selected to be smaller than one micrometer, wherein the coupler volume 380 is, at 0.5 $mm^3$, large enough to realize a highly rigid drive.

As a result, with the injection valve according to the teachings herein, the idle-travel-afflicted mechanical coupling of the piezo actuator to the servo valve body, such as is known to be problematic from the prior art, is replaced by a hydraulic coupling in a play compensation means integrated into the servo valve. In this way, the compensation of changes in length resulting from temperature effects and wear at the contact points in the drive is improved, as is the compensation of changes in length of the piezo actuator itself, for example as a result of changes in the state of polarity.

The reduction of the pressure pulses in the actuator chamber, and thus the reduction of the interference effects on the sensor signal of the piezo actuator, are achieved inter alia as a result of the enlargement of the low-pressure region. In the region of the electrical contacts in the upper region of the injection valve, it is possible for vibrations to be reduced if the piezo head plate lies rigidly in the injector body. By means of said coupling, which operates correctly even for relatively highly volatile fuels, the cumbersome adjustment process for the idle travel during the injector assembly process is eliminated. At the same time, manufacturing costs are reduced. During operation, the activation energy for the piezo actuator is reduced, because the idle travel is eliminated. As a result of the increased precision, the injection quantity scatter dependent on the clamping force in the cylinder head can be reduced, and the injection quantity stability during dynamic engine operation can be improved.

What is claimed is:

1. An injection valve with servo-valve control for injecting fuel into a combustion chamber of an internal combustion engine, the injection valve comprising:

an injector body with an injection nozzle including a nozzle module with a nozzle body and a nozzle needle;

the nozzle module arranged facing toward the combustion chamber; and a nozzle spring arranged to exert a closing force on the nozzle needle;

a high-pressure line with a first connection to a high-pressure fuel system and a second connection via an inflow throttle to a control chamber;

the control chamber connected via an outflow throttle to a valve chamber;

a valve body arranged in the valve chamber;

a valve spring pushing the valve body away from a throttle plate to maintain a gap between the valve body and the throttle plate; and a valve pin connected to the valve body and an actuator;

the actuator preloaded by an actuator spring;

wherein the valve pin is fitted into the valve body with a clearance forming a sealing gap between the valve pin and the valve body;

the valve body includes bores connecting the valve chamber to the sealing gap;

a lower end of the valve pin is not entirely connected to the valve body forming a coupling volume between the valve pin and the valve body;

wherein the coupling volume is connected via the sealing gap and the bores to the valve chamber; and wherein the sealing gap provides a fluidic connection between the coupling volume and the valve chamber, but, during the time of valve actuation, the sealing gap restricts exchange of fluid between the coupling volume and the valve chamber so that the coupling volume does not change in the time of valve actuation.

2. The injection valve as claimed in claim 1, wherein the actuator spring comprises a corrugated spring or a corrugated tube spring.

3. The injection valve as claimed in claim 1, wherein the actuator comprises piezo elements.

4. The injection valve as claimed in claim 1, wherein the high-pressure fuel line is connected via a nozzle aperture to the interior of the nozzle body.

5. The injection valve as claimed in claim 1, wherein the sealing gap has a width of approximately 1 μm.

6. The injection valve as claimed in claim 1, wherein the coupling volume measures approximately 0.5 $mm^3$.

7. The injection valve as claimed in claim 1, wherein the nozzle needle opens inwardly.

8. The injection valve as claimed in claim 1, wherein the actuator is both preloaded and simultaneously sealed off by a corrugated spring.

* * * * *